US006604469B1

(12) United States Patent
Galvan et al.

(10) Patent No.: US 6,604,469 B1
(45) Date of Patent: Aug. 12, 2003

(54) APPARATUS FOR CONTROLLING OPERATION OF RAILROAD HOPPER CAR DISCHARGE DOORS

(75) Inventors: Guadalupe L. Galvan, DeKalb, IL (US); Robert T. Fischer, Homewood, IL (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 10/134,280

(22) Filed: Apr. 29, 2002

(51) Int. Cl.[7] ..... B61D 3/00
(52) U.S. Cl. ..... 105/289; 105/310
(58) Field of Search ..... 105/304, 308.1, 105/308.2, 310, 296, 299, 289, 248

(56) References Cited

U.S. PATENT DOCUMENTS

| | | | | | |
|---|---|---|---|---|---|
| 1,062,384 | A | | 5/1913 | Campbell | |
| 2,493,468 | A | | 1/1950 | Swann | 105/280 |
| 3,104,623 | A | * | 9/1963 | Dorey | 105/248 |
| 3,256,836 | A | * | 6/1966 | Floehr | 105/248 |
| 3,434,433 | A | * | 3/1969 | Floehr | 105/249 |
| 3,440,761 | A | * | 4/1969 | Floehr | 105/304 |
| 3,469,539 | A | * | 9/1969 | Damy | 105/249 |
| 3,611,947 | A | * | 10/1971 | Nagy | 105/304 |
| 3,654,873 | A | * | 4/1972 | Floehr | 105/248 |
| 4,163,424 | A | * | 8/1979 | Lindauer | 105/304 |
| 4,184,432 | A | * | 1/1980 | Adler | 105/248 |
| 4,601,244 | A | | 7/1986 | Fischer | 105/240 |
| 4,741,274 | A | | 5/1988 | Ferris et al. | 105/240 |
| 5,063,858 | A | | 11/1991 | Dugge | 105/253 |
| 5,601,032 | A | | 2/1997 | Kosch | 105/304 |
| 6,019,049 | A | | 2/2000 | Gaydos et al. | 105/289 |
| 6,279,487 | B1 | | 8/2001 | Gaydos et al. | 105/289 |

* cited by examiner

*Primary Examiner*—S. Joseph Morano
*Assistant Examiner*—Lars A Olson
(74) *Attorney, Agent, or Firm*—John W. Harbst

(57) ABSTRACT

An apparatus for controlling discharge of commodity from a railcar hopper car having a centersill and two laterally spaced door assemblies arranged in registry with two transversely spaced discharge openings on a hopper of the car is disclosed. The doors of the discharge door assemblies are joined to each other by an elongated connector such that they move in unison. The apparatus includes an operating shaft rotatable about a fixed axis extending transverse to and vertically beneath the railcar centersill. A linkage system operably connects the operating shaft to the elongated connector to simultaneously push the door assemblies into their closed position in response to rotation of the operating shaft in a first direction and pulls the door assemblies from their closed position in response to rotation of the operating shaft in a reverse or second direction.

18 Claims, 4 Drawing Sheets

APPARATUS FOR CONTROLLING OPERATION OF RAILROAD HOPPER CAR DISCHARGE DOORS

FIELD OF THE INVENTION

The present invention generally relates to railroad hopper cars and, more particularly, to an apparatus for controlling operation of a pair of discharge doors on a railroad hopper car.

BACKGROUND OF THE INVENTION

A common type of railroad freight car is use today is an open top hopper car wherein the commodity carried by the railcar is discharged therefrom through openings provided on an underside of the car. Such cars are used to haul aggregate, iron ore, coal and other commodities. Such cars offer an advantageously economical method of transporting large amounts of a commodity between locations Such railroad cars generally include a walled enclosure or hopper carried by an underframe of the car. On some hopper cars, the underframe includes a longitudinally elongated centersill or support which is supported, toward opposite ends thereof, by the usual wheeled trucks which ride on tracks or rails. Although the design of the bottom side of the railcar hopper varies considerably, the hopper is typically provided with a plurality of generally funnel shaped discharge openings which extend either parallel to the longitudinal axis of the car (longitudinal openings) or are disposed in pairs on opposite lateral sides of the longitudinal axis of the car (transverse openings). Each type hopper serves a particular need in the railcar industry.

Each railcar is furthermore provided with brakes sets operable in combination with the wheeled trucks. An elongated brake rod or shaft interconnects the brake sets at opposite ends of the car. In some instances, a slack adjuster is provided and extends longitudinally of the car. Suffice it to say, in either instance, the brake rod, shaft or slack adjuster is suspended directly below the centersill of the car. During operation of the car, the path of travel of the brake rod, shaft or slack adjuster is not limited to longitudinal movements. It is important to note, during operation of the railcar, the brake rod, shaft or slack adjuster tends to move both linearly and as well as transversely or laterally relative to the car axis.

To control the discharge of commodity from the hopper, a door assembly is provided in registry with each discharge opening on the car. Each door assembly includes a door which is typically hinged along an upper edge such that, when released, the door gravitationally swings toward an open-position assisted by the commodity moving through the discharge opening.

As will be appreciated, different door operating mechanisms have been proposed to releasably maintain the doors in their closed position. It is important to note, however, such door operating mechanisms are specifically designed to the particular application with which they will find use. For example, a mechanism used to operate longitudinally mounted door assemblies cannot, without substantial redesign, be used to operate transversely arranged door assemblies. Moreover, and primarily because of the disposition of the doors relative to the longitudinal axis of the rail car, mechanisms used to operate longitudinally mounted door assemblies usually require a powered operated driver. As will be appreciated, requiring a powered operated driver to operate such mechanism increases the overall cost of the railcar. Of course, increasing any manufacturing costs is adverse to railcar manufacturers. Thus, those mechanisms used to operate longitudinally mounted door assemblies do not and are not readily useful with those hopper cars having transversely mounted door assemblies.

Designing an apparatus for operating transversely mounted door assemblies on a hopper car also has design challenges. Of course, devices for releasably holding transversely mounted door assemblies in a closed position are known in the prior art. One such device involves using individual hooks or catches in combination with each door assembly. Such prior art design, however, requires a person on each side of the railcar to release the hook or catch whereby allowing the door of the door assembly to swing to an open position. Of course, having a person on each side of the railcar to operate the door operating mechanism is costly and, thus, adverse to the railroad industry. It has also been proposed to join or couple the two doors forming a pair of transversely mounted door assemblies. Such design, however, does not necessarily reduce the persons required to release the doors from their closed position.

Another proposal involves connecting a powered driver to each of the door assemblies as through a linkage arrangement. Besides increasing the cost of the door operating mechanism, such design causes some portion of the linkage arrangement, during at least a portion of its travel, to extend proximate to the path of travel of the brake rod, shaft, or slack adjuster. As will be appreciated, any interference with the brake rod, shaft or lack adjuster movement could prove detrimental to overall operation of the rail car. Accordingly, neither railroad car manufacturers nor the railroad industry are accepting of a door operating mechanism whereby any portion of the device interferes or even possibly interferes with either liner or transverse movements of the brake rod, shaft or lack adjuster. Moreover, some of these heretofore known devices for operating transversely mounted railroad car door assemblies have components which, after the doors are opened, remain in the path of commodity discharge from the hopper car thereby adversely affecting the flow of commodity from the rail car.

Thus, there is a continuing need and desire for an apparatus designed to operate a pair of transversely mounted discharge door assemblies on a railroad hopper car having a centersill without requiring the use of a powered driver and which remains removed from both the linear and transverse paths of travel of the brake rod, shaft, or slack adjuster disposed directly beneath the centersill or support throughout operation of both the apparatus and the rail car.

SUMMARY OF THE INVENTION

In view of the above, and in accordance with this invention, there is provided an apparatus for controlling discharge of commodity from a railcar hopper car having a centersill and two laterally spaced door assemblies arranged in registry with two transversely spaced discharge openings on the hopper car. In one form, the door assemblies are joined to each other by an elongated connector such that they move in unison. In one embodiment, the apparatus of the present invention includes an operating shaft rotatable about a fixed axis extending transverse to and beneath the railcar centersill. A linkage system operably connects the operating shaft to the elongated connector to simultaneously push the door assemblies into their closed position in response to rotation of the operating shaft in a first direction and for pulling the door assemblies from their closed position in response to rotation of the shaft in a reverse or second direction.

In a preferred embodiment, the apparatus of the present invention has a modular design whereby facilitating assembly and retrofitting of the apparatus to rail cars in the field. The operating shaft of the apparatus is suspended beneath and, preferably, from the centersill of the railcar and is preferably configured to extend to opposed sides of the rail car. As such, the door operating apparatus of the present invention is operable from either side of the rail car thus, reducing the number of persons required to effect operation of the door assemblies.

The linkage system for the apparatus of the present invention includes a plurality of articulately interconnected links. Preferably, the links are arranged in an overcenter linkage design which serves as a primary lock to releasably maintain the door assemblies in their closed position while preventing the door assemblies from inadvertently opening during transportation of the rail car. In another embodiment, the apparatus of the present invention includes a secondary lock for holding the door assemblies in their closed portion.

In a preferred embodiment, the linkage system includes two laterally spaced linkages arranged on opposite sides of the brake rod, shaft or slack adjuster after the apparatus of the present invention is assembled to the railcar. Each linkage of the linkage system preferably includes a stop for limiting movement of the respective door toward its open position. Moreover, and in a preferred form, each linkage of the linkage system preferably includes a stop for limiting movement of the respective door toward its closed position.

To facilitate assembly and retrofitting of the apparatus of the present invention to rail cars, the linkage system is preferably adjustable. That is, an operative length of at least one of the links of the linkage system can be adjusted to compensate for tolerance variances between systems and between different rail cars.

In view of the above, a principal object of this invention relates to providing an apparatus for operating a pair of transversely mounted discharge door assemblies on a railroad hopper car.

Another object of the present invention is to provide an apparatus for operating a pair of transversely mounted discharge door assemblies and which may be retrofitted to existing railroad hopper cars.

Still another object of the present invention relates to providing an apparatus for operating a pair of transversely mounted discharge door assemblies mounted on railroad hopper car which is economical to manufacture, minimizes the people required to operate the apparatus, and which is operable from either side of the railroad car.

Yet another object of the present invention relates to providing an apparatus capable of operating a pair of transversely mounted discharge door assemblies mounted on railroad hopper and which embodies a linkage system which operates in compression as the door assemblies move toward a closed position.

Still a further object of the present invention relates to providing an apparatus capable of operating a pair of transversely mounted discharge door assemblies mounted on railroad hopper and which ensures the door assemblies remain in position after being releasably closed.

These and other objects, aims, and advantages of the present invention will become more readily apparent from the following detailed description, the drawings and the appended claims.

DETAILED DESCRIPTION OF THE INVENTION

Figure 2:
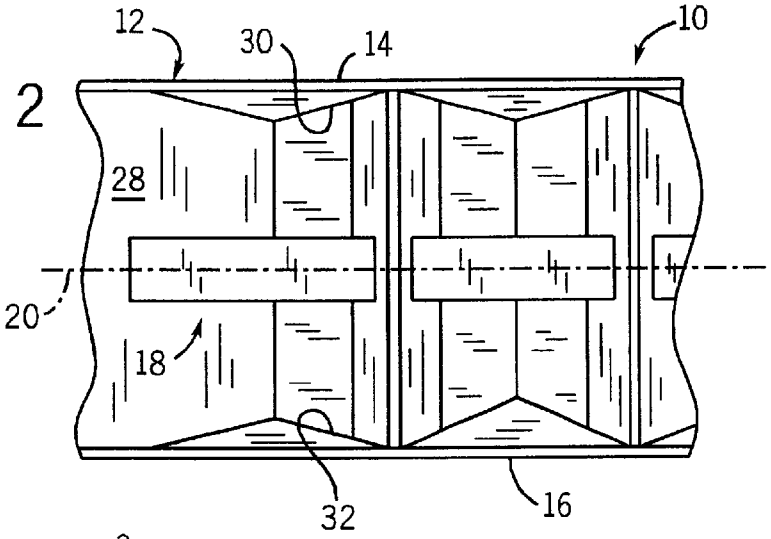
FIG. 2 is fragmentary top plan view of the railroad hopper car illustrated in FIG. 1.

While the present invention is susceptible of embodiment in various forms, there is shown in the drawings and will hereinafter be described in detail a preferred embodiment of the invention with the understanding the present disclosure is intended to set forth an exemplification of the invention which is not intended to limit the invention to the specific embodiment illustrated.

Figure 1:
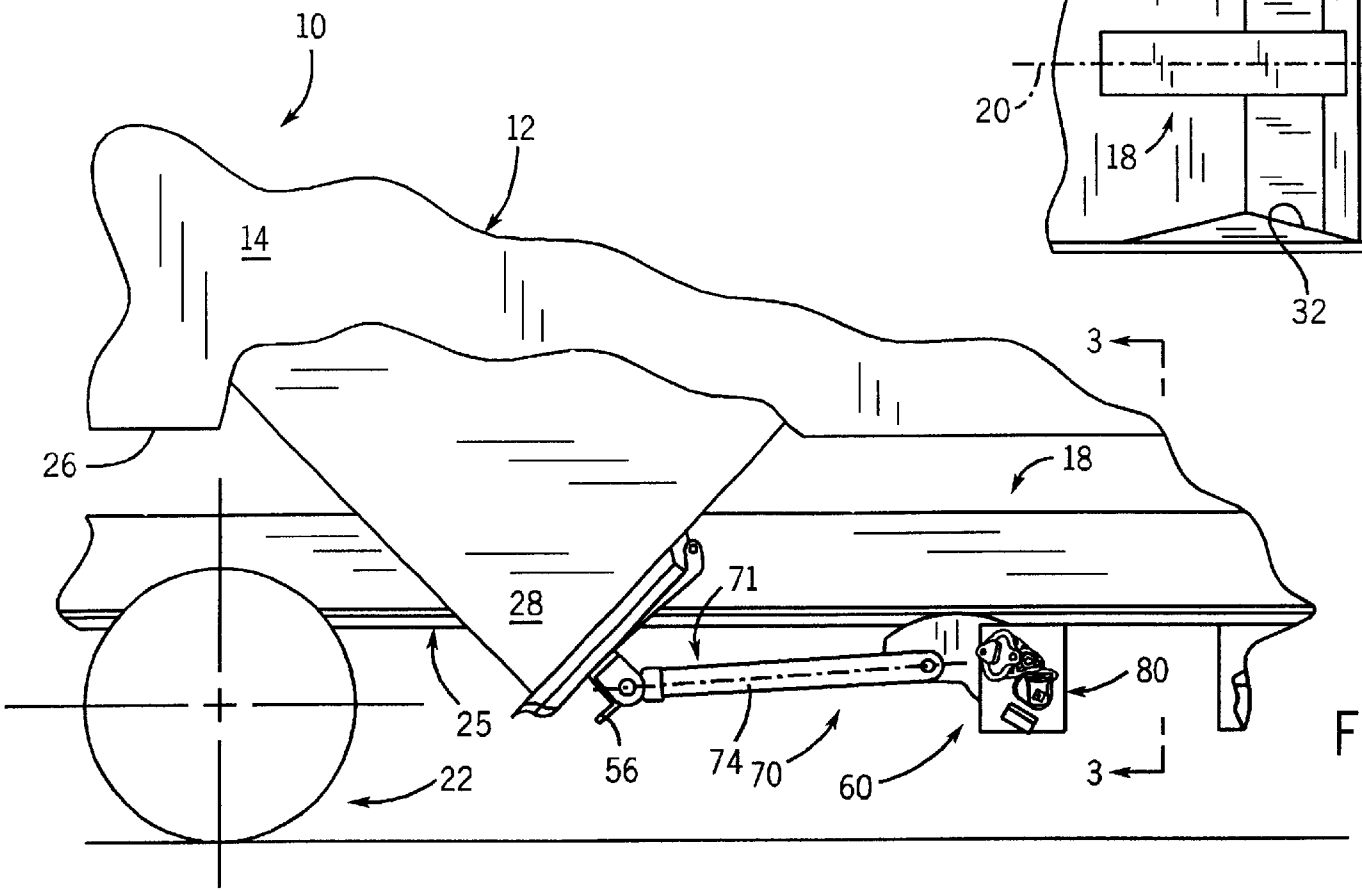
FIG. 1 is a side elevational view, with parts broken away, of a railroad hopper car embodying the present invention.

Referring now to the drawings, wherein like reference numerals indicate like parts throughout the several views, there is shown in FIGS. 1 and 2 a railroad hopper car, generally identified by reference numeral 10. Although hopper cars have a variety of configurations, they generally have a walled enclosure or hopper 12 for storing and transporting commodity therewithin. Hopper 12 is defined by a pair of generally parallel sides 14 and 16 and opposed ends (not shown). In most configurations, the hopper 12 has an open upper end, but the same could be closed, if so desired, with appropriate compartment doors being provided.

As shown in FIG. 1, hopper 12 is supported and carried by an underframe or centersill 18 extending substantially the length of and defining a longitudinal axis 20 (FIG. 2) for the car 10. The underframe 18 is supported toward opposed ends of the car 10 by conventional wheeled trucks, generally identified by reference numeral 22. As known, each wheeled truck 22 includes at least one pair of laterally spaced wheels which turn about an axis extending generally normal to the longitudinal axis 20 of car 10 (FIG. 2) and which ride on laterally spaced rails or tracks.

Figure 3:
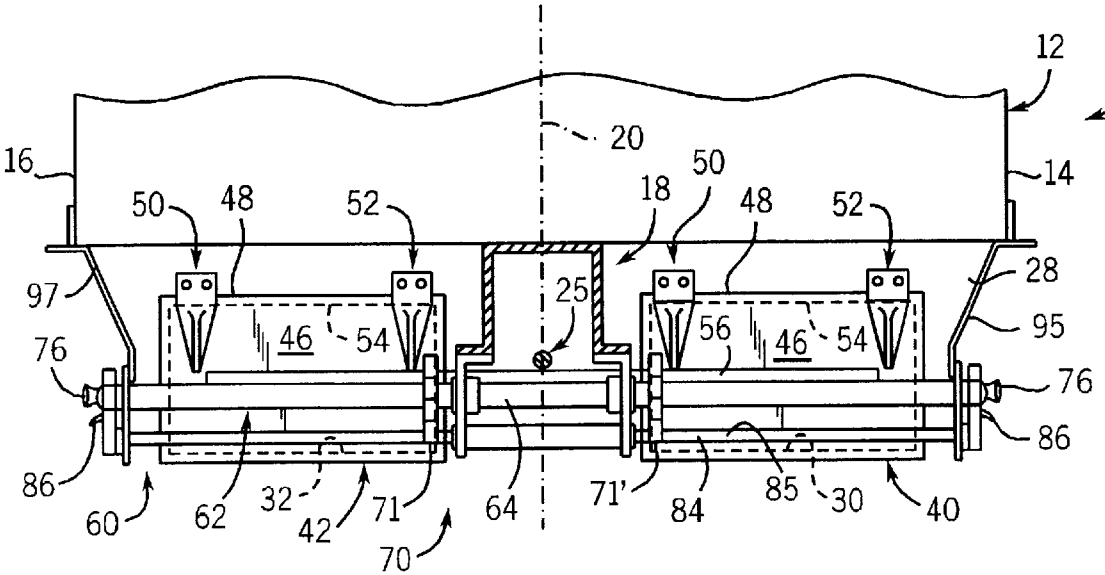
FIG. 3 is a transverse sectional view taken along line 3—3 of FIG. 1.
Figure 4:
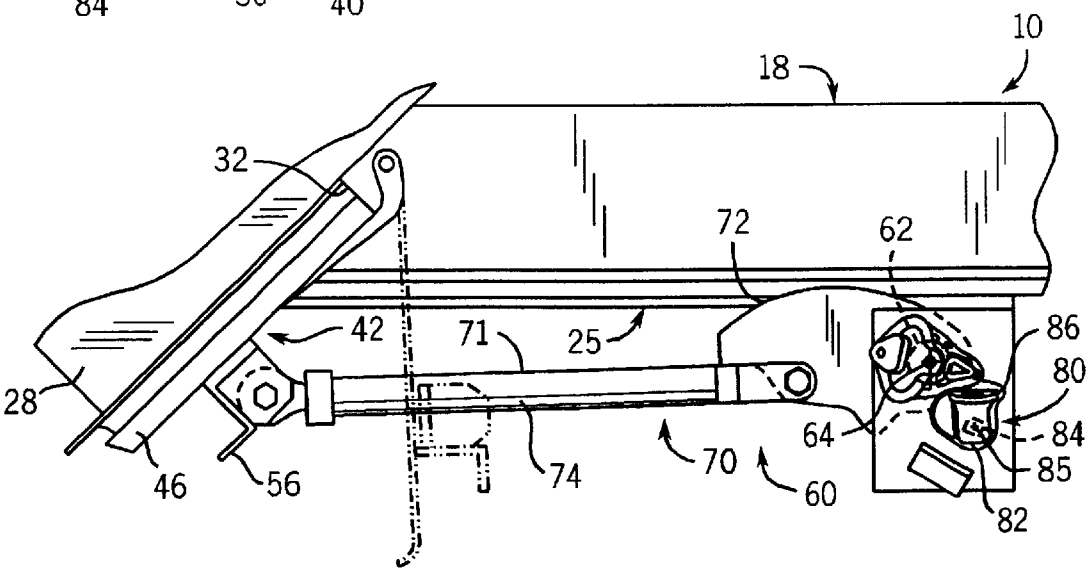
FIG. 4 is an enlarged side view of the door operating apparatus of the present invention.

As is known, each wheeled truck 22 furthermore includes a conventional brake mechanism (not shown). The brake mechanisms at opposite ends of the car 10 are typically connected to each other by a longitudinally elongated brake rod or shaft which can include a slack adjuster, collectively identified by reference numeral 25 (FIGS. 1, 3, and 4). As schematically shown, such longitudinally elongated brake rod, shaft or slack adjuster 25 is typically suspended directly beneath the centersill 18 of the railcar 10. As known in the art, the path of travel or movement of the elongated brake rod, shaft and slack adjuster 25 involves both a linear component as well as a limited lateral or traversing component.

A bottom 26 (FIG. 1) of the hopper 12 can also take a variety of configurations. Suffice it to say, in the exemplary embodiment, the bottom 26 of the hopper 12 is provided with a plurality of longitudinally spaced funnel shaped chutes 28 (with only on being illustrated for illustrative purposes) between opposed end walls of the hopper 12. As illustrated in FIG. 2, each chute 28 defines a pair of transversely spaced openings 30 and 32 arranged on opposite sides of the longitudinal axis 20 and through which commodity is discharged from the hopper 12.

Turning to FIG. 3, a pair of transversely spaced door assemblies 40 and 42 are arranged in registry with the discharge openings 30 and 32, respectively, to control the discharge of commodity from the hopper 12. As shown, each door assembly 40, 42 includes a door 46 hinged toward an upper edge 48 thereof to the hopper 12 by transversely spaced hinges 50 and 52 which allow the door 46 to pivot about a generally horizontal axis 54 extending generally normal to the longitudinal axis 20 of car 10. In one form, a transverse cross bar or connector 56 couples the doors 46 of the assemblies 40, 42 to each other. In such embodiment, the doors 46 of the door assemblies 40, 42 will simultaneously together with each other. In the illustrated embodiment, the transverse crossbar or connector 56 has a generally Z-shape with one leg of the connector 56 being attached to a generally flat surface on the door 46 of each door assembly 40, 42.

According to the present invention, an apparatus 60 for controlling the discharge of commodity from the hopper car 10 as through selective operation of each pair of transversely arranged door assemblies 40, 42 is provided. The apparatus 60 of the present invention is preferably modular in design and is suspended between adjacent chutes 28 on the car 10 and in the direction the door 46 of each door assembly 40, 42 is going to open.

In the embodiment illustrated in FIG. 3, apparatus 60 includes an elongated operating shaft 62 which rotates about a fixed generally horizontal axis 64. As shown, the operating shaft 62 extends transverse to and beneath the centersill or support 18. Preferably, the operating shaft 62 is of sufficient length to extend across the rail car 10 such that opposed ends of the shaft 62 are readily accessible from opposed sides 14, 16 of car 10.

Turning to FIG. 4, operating shaft 62 is operably connected to the door assemblies 40, 42 through a linkage system 70. Linkage system 70 includes a linkage 71 having multiple links 72, 74 which are articulately interconnected to each other and to the discharge doors 46 and operate under compression as the doors 46 move toward a closed position. Notably, linkage 71 is purposefully arranged in laterally spaced relation from the path of movement of the elongated brake rod, shaft or slack adjuster 25 on car 10 to avoid any interference therewith.

In the embodiment illustrated in FIG. 4, link 72 is configured as a lever which radially extends away from the axis 64 and is nonrotatably secured or connected to shaft 62. As shown, link 74 is preferably configured as an elongated connector articulately joined toward one end to a location on the lever 72 radially spaced from axis 64. Link 74 is articulately connected toward an opposed end to the connector 56 joining the doors 46.

In a preferred embodiment, the links 72, 74 and their respective connections to the door assemblies 40, 42, to each other, and relative to axis 64 are arranged in an overcenter linkage design which serves as a primary lock for maintaining the door assemblies 40, 42 in their closed position. That is, when the door assemblies 40, 42 are closed, the connection between lever 72 and link 74 assumes an overcenter position relative to the axis 64 of operating shaft 62 and the location whereat link 74 is joined to the connector 56 to positively maintain the door assemblies 40, 42 in their closed position. Notably, the connection between lever 72 and link 74 is required to move overcenter when the door assemblies 40, 42 are moved from their closed position to their open position.

Returning to FIG. 3, the operating shaft 62 is preferably provided, toward each end, with an operating handle 76 configured to releasably accommodate a conventional opening bar (not shown) for manually rotating the operating shaft 62. Each operating handle 76 is nonrotatably secured to the shaft 62 and is disposed for ready accessability from each side 14, 16 of the car 10. Moreover, each operating handle 76 rotates in a generally vertical plane extending normal to the fixed axis 64. As will be appreciated, providing an operating handle 76 toward each end of operating shaft 62 allows the apparatus 60 to be manually operated from either side 14, 16 of the railcar 10, thus, yielding control over the position of the door assemblies 40, 42 and thereby control over the discharge of commodity from either side 14, 16 of the car 10.

Figure 5:
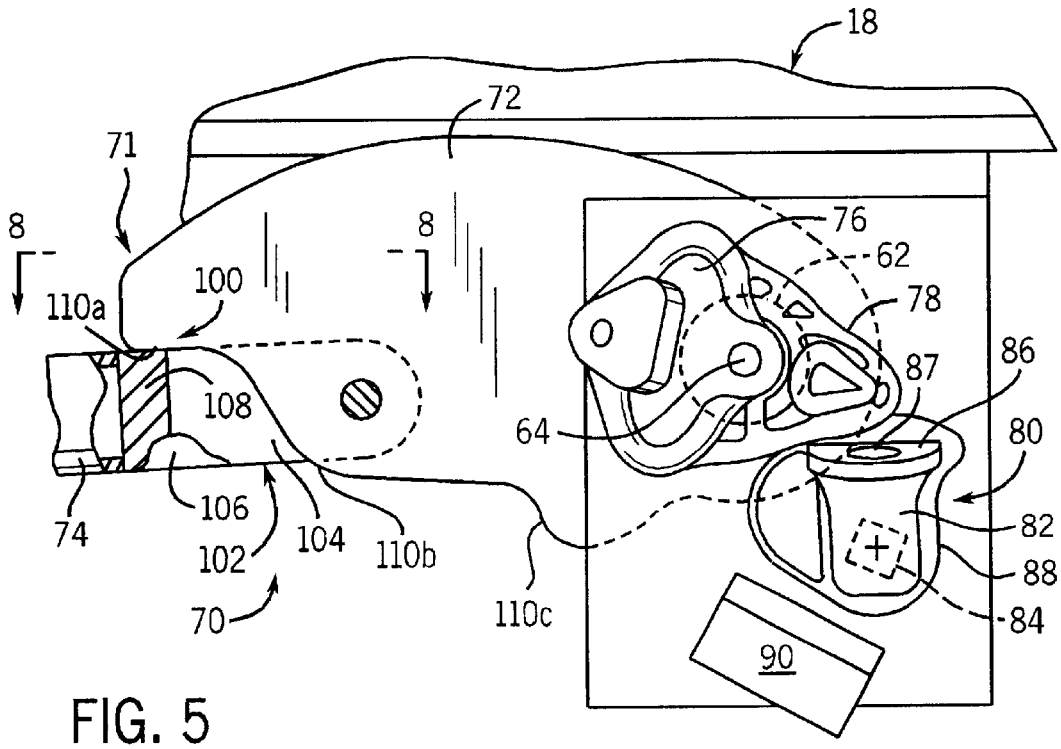
FIGS. 5 and 6 are enlarged side views of a portion of the door operating apparatus shown in FIG. 4.
Figure 6:
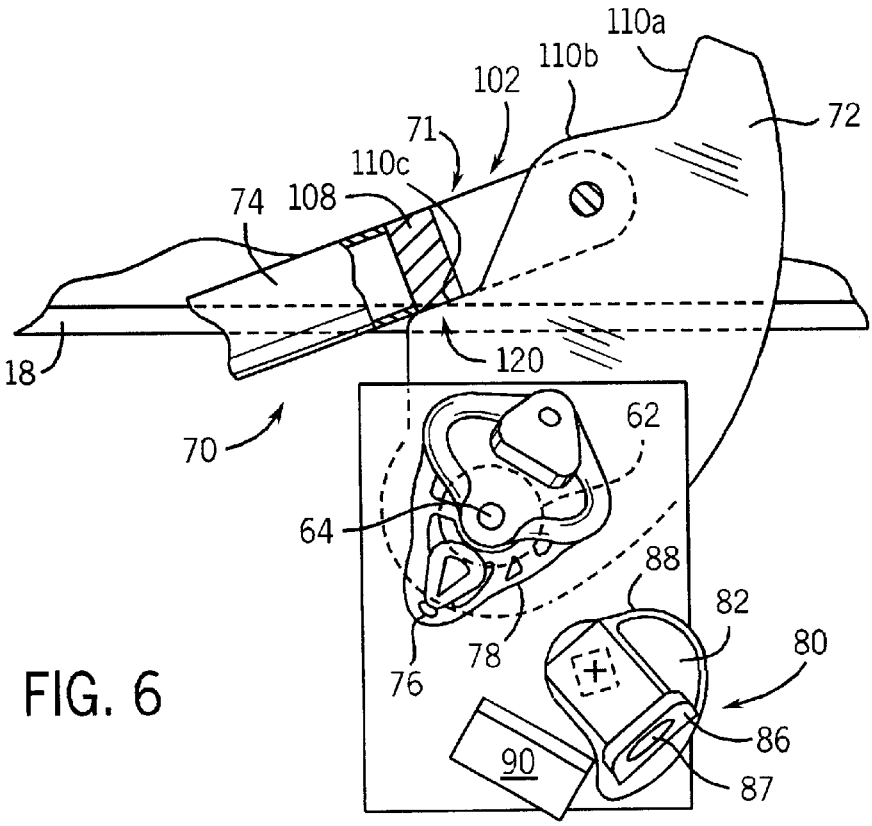

As shown in FIGS. 4, 5 and 6, apparatus 60 furthermore preferably includes a secondary lock 80 for maintaining the door assemblies 40, 42 in their closed position. In one form, the secondary lock 80 includes member 82 which inhibits inadvertent rotation of the operating shaft 62 in a direction to open the door assemblies 40, 42 after the door assemblies 40, 42 are pushed into their closed position. In the illustrated embodiment, each operating handle 76 on the operating shaft 62 has a locking member 82 arranged in operable association therewith. Preferably, and as shown in FIG. 3, the locking members 82 are interconnected by an elongated transverse rod or shaft 84 rotatable about a fixed axis 85 whereby release of either locking member 82 effects simultaneous release of the secondary lock 80.

In the illustrated embodiment, the releasable locking members 82 at opposite ends of shaft 84 are substantially identical relative to each other. Accordingly, a description of only one releasable locking member 82 will suffice to provide an understanding of both locking members 82. Each locking member 82 rotates in a vertical plane extending generally normal to axis 85 and preferably includes an extension 86 projecting away from the plane of rotation of the locking member 82 to facilitate manual operation of the locking member 82. As illustrated in FIGS. 5 and 6, extension 86 defines an aperture or opening 87 for releasably accommodating a conventional tool (not shown) which can be used to promote rotation of the locking member 82, if required.

Preferably, each locking member 82 furthermore includes an exterior cam surface 88 which is configured to coact with a camming surface 78 on each operating handle 76. Suffice it to say, the cam surface 88 on each lock member 82 and the camming surface 78 on an associated operating handle 76 are configured to promote movement of the linkage system 70 to an overcenter and locked condition as locking member 82 is moved into a locked position illustrated in FIG. 5. As shown in FIG. 5, when the locking member 82 is in the locked position, locking member 82 is operably disposed in the plane of rotation of and, thus, prevents inadvertent rotation of the associated operating handle 76 or the operating shaft 62 thereby inhibiting inadvertent release of the primary lock maintaining the door assemblies 40, 42 in their closed position.

As shown in FIG. 6, when the door assemblies 40, 42 (FIG. 3) are to be moved to an open position, the locking members 82 are rotated out of operable engagement with the associated operating handle 76. As such, the operating shaft 62 can be rotated to impart movement to the linkage system 70 in a manner opening the door assemblies 40, 42 (FIG. 3) thereby allowing for discharge of commodity from the hopper. In a most preferred embodiment, a stop 90 is provided in combination with apparatus 60 to limit rotation of the locking member 82 from a locked position (FIG. 5) to an unlocked position (FIG. 6).

Figure 7:
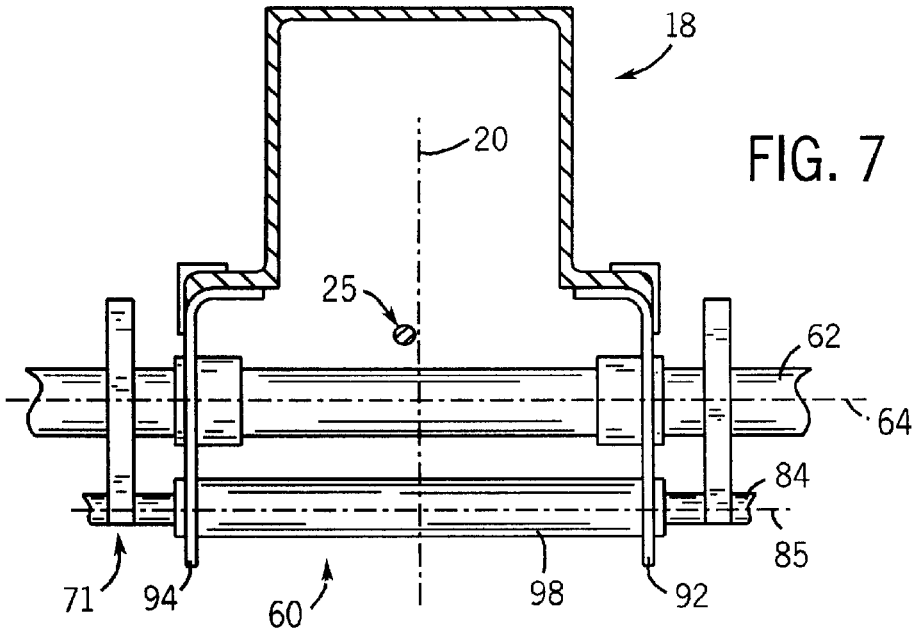
FIG. 7 is an enlarged view of one form of mounting mechanism for suspending the apparatus of the present invention from a railcar centersill.

In that form shown in FIG. 7, apparatus 60 is suspended as a modular assembly from and beneath the railroad car centersill 18. As shown, a pair of generally parallel support brackets 92 and 94 are suitably secured to and depend from the centersill 18. The brackets 92 and 94 are laterally spaced apart a sufficient distance to provide stability to the elongated shafts 62 and 84 journalled for rotation relative to the brackets 92, 94. As illustrated in FIG. 3, additional supports or brackets 95 and 97, depending from opposed sides 14 and 16, respectively, of the railcar hopper 12 can also be provided to add additional support for either one or both of the elongated shafts 62 and 84.

As shown in FIG. 7, an elongated bushing 98 preferably surrounds the lengthwise portion of shaft 84 extending between the brackets 92 and 94. As will be appreciated, the bushing 98 inhibits at least that lengthwise portion of shaft 84 extending between the supports 92, 94 from bowing. As such, the bushing 98 adds stability to apparatus 60 and assists in retrofitting apparatus 60 as a modular assembly to the rail car.

Figure 8:
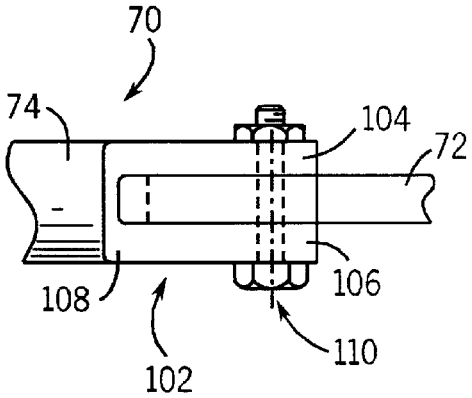
FIG. 8 is a fragmentary plan view taken along line 8—8 of FIG. 5.

Preferably, apparatus 60 furthermore includes a stop 100 (FIG. 5) for limiting movement of the door assemblies 40, 42 toward their closed position. As shown in FIGS. 5 and 8, the end of link 74 articulately connected to link 72 is preferably provided with a generally U-shape connector or clevis 102 including a pair of parallel arms 104 and 106 which embrace the lever 72 therebetween and which are joined by a bight portion 108. A suitable connector 110, such as a conventional pin or bolt, passes endwise through the arms 104, 106 and through the lever or link 74 to operably and articulately connect link 74 to link 72 at a distance radially spaced from the axis of rotation of the lever 72.

As shown in FIG. 5, lever 72 has a peripheral face, significant portions of which are identified as 110*a* through 110*c*. As the apparatus 60 is operated to push the door assemblies 40, 42 into their closed position, the operating shaft 62 is rotated, as shown in FIG. 5, in a counterclockwise direction with lever 72 moving therewith in a counterclockwise direction. As will be appreciated from FIG. 5, rotation of shaft 62 in a counterclockwise direction to close door assemblies 40, 42 (FIG. 3) continues until portion 110*a* of lever 74 engages portion 108 of clevis 102. As such, further rotation of the lever 72 and, thus, shaft 62 is stopped or prevented by the abutting relationship of portion 110*a* on lever 72 against the clevis 102. Notably, portion 110*a* of lever 82 is specifically configured such that when abutment occurs between portion 110*a* and clevis 102, the linkage system 70 and, more particularly, links 72 and 74 have assumed an overcenter relation relative to each other and the door assemblies 40, 42 are closed.

Preferably, apparatus 60 furthermore includes a stop 120 (FIG. 5) for limiting movement of the door assemblies 40, 42 toward their open position. As apparatus 60 is operated to pull the door assemblies 40, 42 from their closed position, and following conditioning of lock 80, shaft 62 is rotated in a clockwise direction, as shown in FIG. 6, with lever 72 moving therewith. As will be appreciated from FIG. 5, rotation of operating shaft 62 in a clockwise direction to open the door assemblies 40, 42 (FIG. 3) continues until portion 110*c* of lever 72 engages bight portion 108 of clevis 102. As such, further clockwise rotation of the lever 72 and, thus, operating shaft 62 is stopped or prevented by the abutting relationship of portion 110*c* on lever 72 against the clevis 102. Notably, portion 110*c* of lever 72 is specifically configured such that when abutment occurs between portion 110*c* and clevis 102, the door assemblies 40, 42 are in a fully open position.

Figure 9:
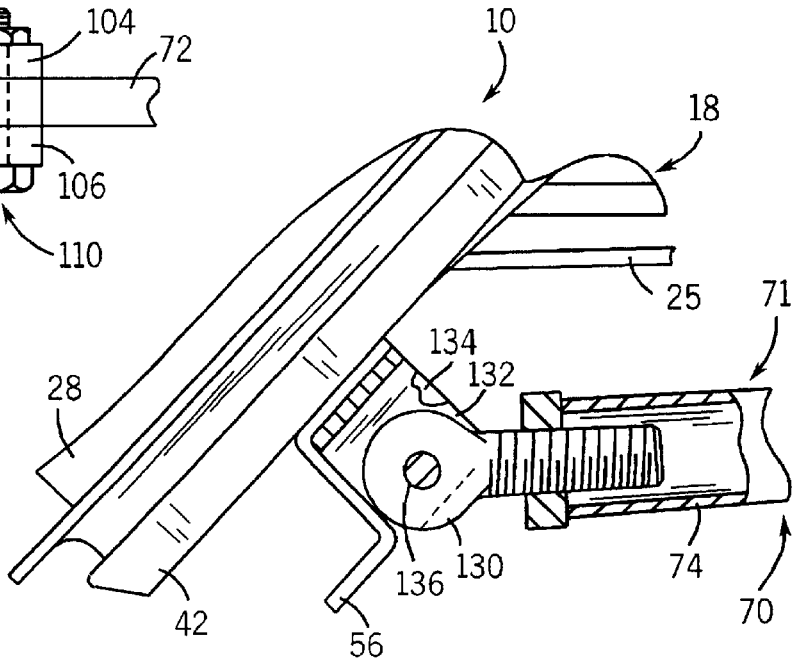
FIG. 9 is an enlarged side view of another portion of the door operating apparatus shown in FIG. 4.

Preferably, and to facilitate retrofitting and modular assembly of apparatus 60 to a railcar, the overall operable length of the linkage system 70 is adjustable. In the embodiment shown, the overall operable length of linkage system 70 is adjustable as through adjustment of the operable length of link 74. In the exemplary embodiment shown in FIG. 9, a linearly adjustable eye bolt 130 is threadably accommodated within and linearly extends an adjustable length from the end of link 74 opposite from lever 72. As shown, the eye bolt 130 is embraced between a pair of parallel arms 132, 134 extending from and connected to the crossbar or connector 56. A suitable connector 136, such as a conventional pin or boly, serves to releasably and articulately connect the end of link 74 to the crossbar 56.

In the embodiment shown in FIG. 3, to ensure apparatus 60 simultaneously operates both door assemblies 40, 42, the linkage system 70 for apparatus can include a pair of linkages 71 and 71' Preferably, linkage 71' is substantially identical to linkage 71 discussed above and, thus, no further detail need be provided for a complete understanding thereof. Suffice it to say, when a pair of linkages, such as 71 and 71' are included as part of linkage system 70 to control simultaneous operation of the discharge door assemblies 40, 42, the linkages 71, 71' are disposed in laterally spaced relation along the length of the operating shaft 64 so as to avoid interference with either longitudinal and/or transverse movements of the brake rod, shaft or slack adjuster 25.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. An apparatus for controlling discharge of commodity from a railcar having a centersill defining a longitudinal axis for the car, a hopper supported by said centersill, said hopper defining at least two discharge openings arranged to opposite lateral sides of said axis, with said railcar further including two laterally spaced door assemblies mounted on said hopper and which are joined by an elongated connector, with each door assembly being mounted for pivotal movement between an open and a closed position relative to a respective discharge opening in said hopper, said apparatus comprising:

an elongated operating shaft rotatable about a fixed axis and adapted to extend transverse to and vertically beneath said centersill, said operating shaft being configured to extend across said railcar such that opposed ends of said shaft are each accessible from to a lateral side of the railcar; and a linkage system adapted to operably connect said operating shaft and said elongated connector to simultaneously push said door assemblies into their closed position in response to rotation of said operating shaft in a first direction and to simultaneously pull said door assemblies from their closed position in response to rotation of said operating shaft in a second direction, with said first and second directions being opposed to one another, with said linkage system consisting of two interconnected links, with a first link being connected toward one end to and movable with said operating shaft and a second link being connected toward one end to said elongated connector.

2. The apparatus according to claim 1 wherein said linkage system includes a stop for limiting movement of said door assemblies toward an open position.

3. The apparatus according to claim 1 wherein said linkage system includes a stop for limiting movement of said door assemblies toward their closed position.

4. The apparatus according to claim 1 wherein said first and second links of said linkage system are positioned in an overcenter arrangement when said door assemblies are in the closed position, with said overcenter arrangement of said links serving as a primary lock to releasably hold said door assemblies in their closed position while preventing them from inadvertently moving toward an open position.

5. The apparatus according to claim 4 further including a secondary lock for holding said door assemblies in their closed position.

6. An apparatus for controlling discharge of commodity from a railcar having a longitudinally extending centersill, an elongated member suspended within or directly beneath said centersill for both longitudinal and transverse movements, a hopper supported by said centersill and defining a pair of transversely spaced discharge openings through which said commodity is discharged, with said railcar further including a pair of transversely spaced doors arranged in respective alignment relative to said transversely spaced discharge openings and which are joined to each other by an elongated connector, with each door being supported by transversely spaced hinges arranged toward an upper side of each door for movement between a closed position and an open position whereby controlling the discharge of commodity from said hopper, said apparatus comprising:

an elongated operating shaft adapted to be suspended from and beneath said centersill for rotation about a fixed axis extending generally normal to said centersill, said elongated shaft being configured to allow for operation of said apparatus from either lateral side of said railcar; and a linkage system disposed along the length of said operating shaft so as to avoid interference with either longitudinal or transverse movements of said member, said linkage system being operably disposed between said operating shaft and said elongated connector to push said doors into their closed position in response to rotation of said elongated shaft in a first direction and to pull said doors from their closed position in response to rotation of said elongated shaft in a second direction, with said first and second directions being opposed to one another, with said linkage system including two laterally spaced linkage disposed along said operating shaft such that they remain to opposite lateral sides of the elongated member after said apparatus is arranged in operable combination with said hopper car, with each linkage including multiple interconnected links, and wherein an operable length of each linkage is adjustable to compensate for tolerance variances.

7. An apparatus for controlling discharge of commodity from a railcar having a centersill defining a longitudinal axis for the car, a hopper supported by said centersill, said hopper defining at least two discharge openings arranged to opposite lateral sides of said axis, with said railcar further including two laterally spaced door assemblies mounted on said hopper and which are joined by an elongated connector, with each door assembly being mounted for pivotal movement between an open and a closed position relative to a respective discharge opening in said hopper, said apparatus comprising:

an elongated operating shaft rotatable about a fixed axis and adapted to extend transverse to and vertically beneath said centersill, said operating shaft being configured to extend across said railcar such that opposed ends of said shaft are each accessible from to a lateral side of the railcar; and a linkage system adapted to operably connect said operating shaft and said elongated connector to simultaneously push said door assemblies into their closed position in response to rotation of said operating shaft in a first direction and to simultaneously pull said door assemblies from their closed position in response to rotation of said operating shaft in a second direction, with said first and second directions being opposed to one another, and wherein an operable length of said linkage system is adjustable to readily compensate for tolerance variances whereby facilitating fitting of said apparatus to said rail car.

8. An apparatus for controlling discharge of commodity from a railcar having a longitudinally extending centersill, an elongated member suspended within or directly beneath said centersill for both longitudinal and transverse movements, a hopper supported by said centersill and defining a pair of transversely spaced discharge openings through which said commodity is discharged, with said railcar further including a pair of transversely spaced doors arranged in respective alignment relative to said transversely spaced discharge openings and which are joined to each other by an elongated connector, with each door being supported by transversely spaced hinges arranged toward an upper side of each door for movement between a closed position and an open position whereby controlling the discharge of commodity from said hopper, said apparatus comprising:

an elongated operating shaft adapted to be suspended from and beneath said centersill for rotation about a fixed axis extending generally normal to said centersill, said elongated shaft being configured to allow for operation of said apparatus from either lateral side of said railcar; and a linkage system disposed along the length of said operating shaft so as to avoid interference with either longitudinal or transverse movements of said member, said linkage system being operably disposed between said operating shaft and said elongated connector to push said doors into their closed position in response to rotation of said elongated shaft in a first direction and to pull said doors from their closed position in response to rotation of said elongated shaft in a second direction, with said first and second directions being opposed to one another, and wherein said linkage system consists of two interconnected links, with one link of said linkage system being connected to and movable with and in response to rotation of said operating shaft and a second link being connected toward one end to said elongated connector.

9. The apparatus according to claim 8 wherein each linkage of said linkage system includes a stop for limiting movement of said doors toward an open position.

10. The apparatus according to claim 8 wherein each linkage of said linkage system includes a stop for limiting movement of said doors toward their closed position.

11. An apparatus for controlling discharge of commodity from a railcar having a longitudinally extending centersill, an elongated member suspended within or directly beneath said centersill for both longitudinal and transverse movements, a hopper supported by said centersill and defining a pair of transversely spaced discharge openings through which said commodity is discharged, with said railcar further including first and second transversely spaced doors arranged in respective alignment relative to said transversely spaced discharge openings defined by said hopper, with each door being supported by transversely spaced hinges arranged toward an upper side of each door for movement between a closed position and an open position whereby controlling the discharge of commodity from said hopper, said apparatus comprising:

an elongated operating shaft adapted to be suspended from and beneath said centersill for rotation about a fixed axis extending generally normal to said centersill, said elongated shaft being configured to allow for operation of said apparatus from either lateral side of said railcar; and a linkage system including first and second laterally spaced linkages operably connected to said first and second doors, respectively, with said first and second linkages being disposed along said operating shaft such that they remain to opposite lateral sides of said elongated member after said apparatus is arranged in operable combination with said hopper car, and with each linkage being configured to push the respective door connected thereto into the closed position, in response to rotation of said elongated shaft in a first direction, and to pull the respective door connected thereto from their closed position in response to rotation of said elongated shaft in a second direction, with said first and second directions being opposed to one another, with each linkage consisting of two interconnected links, with a first link of each linkage being connected toward one end to and movable with said operating shaft and a second link of each linkage being connected toward one end to said elongated connector.

12. The apparatus according to claim 11 wherein said links of each linkage being arranged in an overcenter design which serves as a primary lock to releasably hold said doors in their closed position while preventing them from inadvertently moving toward their open position.

13. The apparatus according to claim 12 further including a secondary lock for holding said doors in their closed position.

14. In combination with a railroad hopper car having a longitudinally extending centersill, an elongated rod suspended directly beneath said centersill for both longitudinal and transverse movements, a hopper supported by said centersill and defining a pair of transversely spaced discharge openings through which said commodity is discharged, said railcar further including a pair of transversely spaced doors arranged in respective alignment relative to said transversely spaced discharge openings, with each door being supported by transversely spaced hinges arranged toward an upper side of each door whereby controlling the discharge of commodity from said railroad car, with said doors being operably joined to each other for concomitant movement between a closed position and an open position by an elongated transverse connector, and a modular apparatus for controlling movement of said doors, said apparatus comprising:

an elongated manually actuated shaft suspended from and beneath said centersill for rotation about a fixed axis extending generally normal to said centersill, said elongated shaft being configured to allow for operation of said apparatus from either lateral side of said railcar; and a linkage system laterally disposed relative to said elongated shaft so as to avoid interference with either longitudinal or transverse movements thereof said linkage system being operably disposed between said elongated actuating shaft and said elongated connector for pushing said doors into their closed position in response to rotation of said elongated shaft in a first direction and for pulling said doors from their closed position in response to rotation of said elongated shaft in a second direction, with said first and second directions being opposed to one another, with said linkage system including two laterally spaced linkages disposed to opposite lateral sides of said elongated rod, with each linkage including multiple interconnected links, and wherein an operable length of each linkage is adjustable to compensate for tolerance variances.

15. In combination with a railroad car having a longitudinally extending centersill, an elongated rod suspended directly beneath said centersill for both longitudinal and transverse movements, a hopper supported by said centersill and defining a pair of transversely spaced discharge openings through which said commodity is discharged, said railcar further including first and second transversely spaced doors arranged in respective alignment relative to said transversely spaced discharge openings, with each door being supported by transversely spaced hinges arranged toward an upper side of each door whereby controlling the discharge of commodity from said railroad car, and a modular apparatus for controlling movement of said doors, said apparatus comprising:

an elongated manually actuated shaft suspended from and beneath said centersill for rotation about a fixed axis extending generally normal to said centersill, said elongated shaft being configured to allow for operation of said apparatus from either lateral side of said railcar; and a linkage system including first and second linkages operably connected between said first and second doors, respectively, and said elongated manually actuated shaft, with said first and second linkages being laterally disposed along said elongated shaft and to opposite lateral sides of said elongated rod so as to avoid interference with either longitudinal or transverse movements of said rod, with each linkage being configured to push the respective door connected thereto into the closed position in response to rotation of said elongated shaft in a first direction and to pull the respective door connected thereto from the closed position in response to rotation of said elongated shaft in a second direction, with said first and second directions being opposed to one another, and wherein each linkage of said linkage system consists of two interconnected links.

16. The railroad hopper car according to claim 15 wherein said first and second links of each linkage are positioned in an overcenter arrangement when the respective door connected thereto is in the closed position, and wherein said overcenter arrangement of said links serving as a primary lock to releasably hold the respective door connected thereto in the closed position while preventing the respective door connected thereto from inadvertently moving toward the open position.

17. The railroad hopper car according to claim 16 wherein each linkage of said linkage system further includes a secondary lock for inhibiting inadvertent rotation of said elongated shaft whereby maintaining the respective doors connected to each linkage in the closed position.

18. The railroad hopper car according to claim 15 wherein each linkage of said linkage system includes a first stop for limiting movement of the respective door connected thereto toward the open position and a second stop for limiting movement of the respective door connected thereto toward the closed position.

* * * * *